United States Patent [19]

Tschirky et al.

[11] 3,982,859

[45] Sept. 28, 1976

[54] FLOATING FLOW RESTRICTORS FOR FLUID MOTORS

[75] Inventors: John E. Tschirky, Long Beach; Bela A. Geczy, Glendale, both of Calif.

[73] Assignee: Smith International Corporation, Inc., Newport Beach, Calif.

[22] Filed: July 11, 1975

[21] Appl. No.: 595,054

[52] U.S. Cl. ..... 418/48; 175/107; 175/320; 308/4 A

[51] Int. Cl.[2] ..... F01C 1/10; F01C 21/00; E21B 3/12; E21B 17/00

[58] Field of Search ..... 418/48, 102; 175/107, 175/320, 337; 308/4 A, 122

[56] References Cited

UNITED STATES PATENTS

| | | | |
|---|---|---|---|
| 2,308,316 | 1/1943 | Smith et al. | 308/4 A |
| 3,112,801 | 12/1963 | Clark et al. | 175/107 |
| 3,456,746 | 7/1969 | Garrison et al. | 175/320 |
| 3,489,231 | 1/1970 | Garrison et al. | 418/48 |
| 3,516,718 | 6/1970 | Garrison et al. | 308/230 |

FOREIGN PATENTS OR APPLICATIONS

| | | | |
|---|---|---|---|
| 781,860 | 8/1957 | United Kingdom | 415/502 |

*Primary Examiner*—John J. Vrablik
*Attorney, Agent, or Firm*—Philip Subkow

[57] ABSTRACT

This invention relates to flow restrictors in fluid motors.

7 Claims, 7 Drawing Figures

FLOATING FLOW RESTRICTORS FOR FLUID MOTORS

BACKGROUND OF THE INVENTION

The use of motors in bore hole drilling, especially in drilling for oil and gas but also in mining operations, has been a standard procedure in the art. Such motors are employed to rotate drills for boring in the earth both for forming a bore hole and also for coring. The motors are also useful in oil field operations, such as tube cleaning, milling operation, cement drilling and other operations where it is desired to rotate a rod at the end of which a tool is to be rotated. We refer to such motors as in-hole motors when designed to be run at the end of a pipe and adjacent to the drill bit. In the usual case, the rotor of the motor and the drill bit rotate with respect to a stator which, in turn, is connected to a conventional drill string composed, in the case of the drilling of well bores, of a "kelly," drill pipe, and drill collar as required. This string extends to the surface with the kelly mounted in the rotary table. Where the in-hole motor is a hydraulic motor used as an in-hole motor in drilling, the liquid is the usual drilling fluid, i.e., mud or gas. It serves its usual function in the drilling operation, returning to the surface carrying the detritus, i.e., cuttings resulting from the drilling operation. However, in this combination, the circulating mud has an additional function, and that is to supply the hydraulic power to operate the hydraulic motor.

One of the primary problems resides in the design of the bearing system which will permit operations for periods of economic length.

It has been conventional to rely on a part of the circulating mud to pass through the bearings to lubricate them. Such bearing systems are shown in E. P. Garrison et al, U.S. Pat. No. 3,516,718, issued Jan. 23, 1970, and in Garrison et al U.S. Pat. Nos. 3,456,746 and 3,857,655 issued Dec. 31, 1974. Mud lubrication of bearings has also been applied to turbine-operated drills of the prior art.

When mud-lubricated bearings are employed with motors of the helicoidal type, such as have been employed in the prior art in-hole motors, problems arise with respect to limiting the flow of mud through the bearings; and problems arise from the eccentric motion of the rotor. Such motors are shown in Clark U.S. Pat. No. 3,112,801, patented Dec. 3, 1973 and the above U.S. Pat. No. 3,857,655.

The prior art solutions for limiting the bypass of mud through the bearings are shown in the Garrison patents. These include the provision of a grooved rubber radial bearing which also acts as a flow restrictor to limit the fluid bypassing through the bearings so as not to rob unduly the main flow through the bit nozzles required to provide the necessary flow to remove the cuttings.

Since the rotor of the motor rotates in an eccentric manner, it is necessary to convert this motion into a true rotation about a fixed axis so that the bit may be rotated in the proper manner. This is accomplished by connecting the end of the rotor to a connecting rod by means of a universal joint and connecting the connecting rod to a drive shaft by means of a second universal joint.

Further, while the universal joints do a fairly good job in the case of the helicoidal motors of converting the eccentric motion of the rotor to a rotary motion, there remains a residual force on the drive shaft which is transverse to the axis of rotation. This transverse force is periodic in direction, reversing itself on each reversal of the eccentric motion. Additionally, when drilling in steeply dipping formations or in drilling out dog legs, or in drilling deviated holes, particularly when using bent subs, or bent connecting rod housings at the connecting rod, a thrust is encountered at the bit which is transverse to the bit axis. The result is a transverse displacement of the shaft and a transverse force applied to the radial bearing employed, for example, the rubber bearing referred to or any other radial bearing which may be employed.

Problems have arisen in such prior art combination. The rubber radial bearings, which even in the first place, due to molding limitations, do not act adequately to restrict the amount of bypass, deteriorate in use and result in premature failure. This failure includes erosion of the bearing passageways where the grooves are washed out.

Circulating mud usually contains fine particles of "sand" resulting from the drilling operation. The mud returning up the annulus is separated from the cuttings, but some fine particles produced by the drilling operation escape in the treated mud. The returning mud passing at high volumetric velocity through the grooves in the rubber flow restrictor erodes the grooves. The result is that the pressure drop through the restrictor is reduced and a large portion of the input mud is bypassed.

The percentage of the fluid bypassed, even with newly formed radial bearings, may be excessive because it is difficult to mold such bearings to form passageways through the bearings that will have the desired flow resistance and yet provide a suitable bearing surface which will not have excessive frictional resistance. The erosion of the rubber by the mud is also a problem.

Experience has shown that an eroded marine bearing employed as a radial bearing permits an excessive flow through the bearing flutes, under the above flow conditions. Such flow rates may range up to about 20% of the total volumetric flow rates. This is an excessive bypass flow. In order to reduce the flow, a separate flow restrictor is added, as is shown in the above Garrison U.S. Pat. No. 3,456,746. This may reduce the flow in the range of about 5 to 10% of the total flow, depending on the magnitude of the volumetric flow rate of the mud. The greater the percentage of the bypass, the greater the volumetric flow rate.

It is to be recognized that the pressure drop between the stator discharge to the annulus exterior of the drill may be in the order of 200 to 1500 pounds per square inch and the volumetric rate of flow from 50 to about 600 gallons per minute, depending upon the depth, nature of the mud, size of the tool, and designs of the nozzles of the bit.

Excessive bypass flow through the bearing system imposes excessive erosion of the thrust bearings. A bypass flow has been experienced, in the prior art, of about 5 to about 30 gallons per minute, that is, about 5 to about 10% of the volumetric flow rate in the range of the pressure drops referred to above. An increase in volume flow through the marine bearing, flow restrictor, and thrust-bearing packages may thus rise to excessive magnitude.

The pressure drop and volume rate of flow of the mud through the motor depend on the horsepower requirement and rpm of the drilling effort. This establishes the gallons per minute of mud that must be circulated. The mud input pressure is fixed by the total pressure drop through the drill string, the hydraulic motor, bit nozzles and annulus pressure drop. The volume bypassed through the bearings is subtracted from the flow through the nozzles. The pump must provide for sufficient input to supply the required flow rate and pressure drop. The bit manufacturer usually supplies the nozzle pressure drop to give the required lifting effect and cutting action. Furthermore, the depth to which a well may be serviced by a given pump assembly and therefore the limit of bit advance depend on the permissible horsepower required to move the mud through the motor to and through the bit nozzles and return the cuttings to the surface. Any additional demand on the pump, required to supply excessive bypass, is a limitation on the depth to which a given drilling rig can go. Additional pump capacity is thus required.

It is difficult to build a rubber bearing which is so finely tuned as to meet these parameters and not permit an excessive flow through the bearings. Furthermore, as has been stated above, pressure drops tend to erode the passageways in the rubber bearing so that they do not for long retain their original cross-sectional areas.

Statement of the Invention

It is the object of our invention to improve the operation of hydraulic motors by employing stable flow restrictors having hardness values which will resist erosion by abrasive particles present in the fluid used to lubricate the bearing package. Such hydraulic motors include the positive displacement type referred to above or the turbine type known as the turbo drill. Instead of rubber radial bearings of the marine bearing types, radial bearings made of ceramic and hard material, such as tungsten carbide, have been used. See copending applications Ser. No. 388,586 filed Aug. 15, 1973 and Ser. No. 544,143 filed Jan. 27, 1975. Such bearings were relied on in said applications to act as flow restrictors. While we may use such radial bearings, we do not in the present invention rely on such bearings and may use conventional roller or ball bearings.

The flow restrictor of our invention is, by reason of its composition, resistant to erosion, and its dimensional stability is aided by the mechanical construction.

The restrictor of our invention maintains a stable bypass volume despite any transverse movement of the shaft. The restrictor is formed of a sleeve flexibly mounted on the shaft and spaced from a stationary sleeve mounted to the housing of the motor. The space between the sleeves forms a flow passageway of substantially stable cross-sectional area. The sleeve mounted on said shaft is termed floating, in the sense that it is mounted so that the shaft may be displaced radially with respect to the floating sleeve. The mounting provides an annular space between the shaft and the sleeve.

In our preferred embodiment, the cooperating faces of the sleeves are made of material having a hardness greater than that of the cuttings which may be contained in the circulating mud.

Provision is made for a relatively large radial displacement of the shaft before impact forces are applied to the cooperating surfaces of the flow restrictor. When the surface of the flow restrictor channel is formed of relatively non-elastic material, such as is preferred and as is described below, the provision of a substantial play of the shaft before impact on the flow restrictor prolongs the life and function of the flow restrictor. The flow restrictor of our invention is not relied on to provide any bearing function.

The floating sleeve may be and in our preferred embodiment is used in cooperation with a packing gland to form a seal between the hydraulic fluid passing through the flow restrictor and the lubricated bearing assemblies. See U.S. Pat. No. 3,857,655. In order to minimize the pressure drop across the packing gland, we may and prefer to use a vent bore positioned between the discharge of the annular passageway of the flow restrictor and the packing gland as is described in the copending application Ser. No. 388,586. However, the vent bore may be plugged, if so desired, in which case the pressure drop across the packing gland or seal is substantially equal to the pressure drop across the bit.

In order to avoid impact of the floating sleeve on the complementary sleeve mounted to the housing, the floating sleeve is restrained against displacement towards the complementary sleeve by a suitable radial bearing positioned at the end of the floating sleeve between a packing gland and the bearing assembly. The bearing has the additional function of permitting rotation of the floating sleeve with the shaft with low friction.

As is described in the above copending application, the sleeve makes a seal fit with a suitably mounted packing gland mounted between the annular passageway at the flow restrictor and suitably mounted radial and thrust bearings.

The sleeve, although flexibly connected to the shaft at the upper end, is restrained from deflection at its lower end by a suitable radial bearing. The bearing, acting together with the packing gland, thus effectively restrains the floating sleeve from transverse displacement. The result is to maintain the integrity of the seal at the packing gland and to avoid damage to the hard material employed in the floating sleeve and complementary sleeve.

The invention will be further described by reference to the following figures.

Figure 1:
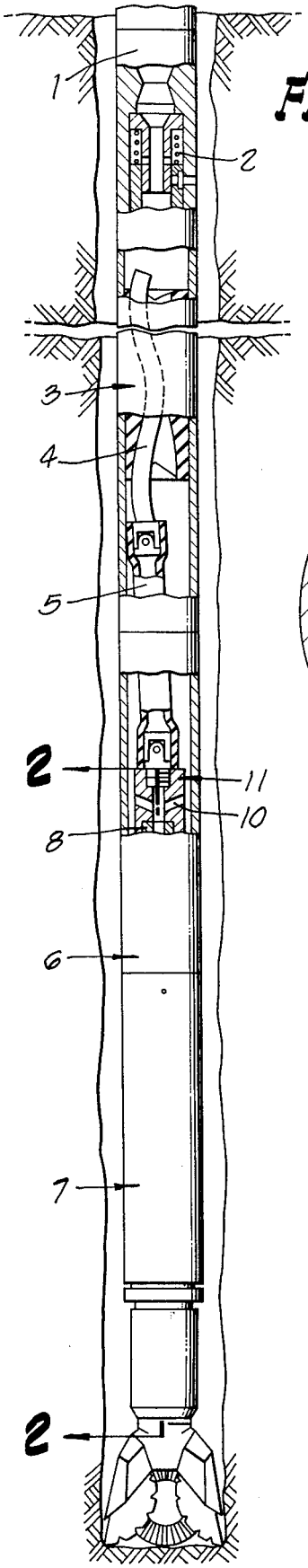
FIG. 1 is a schematic view of a preferred application of my invention.
Figure 3:
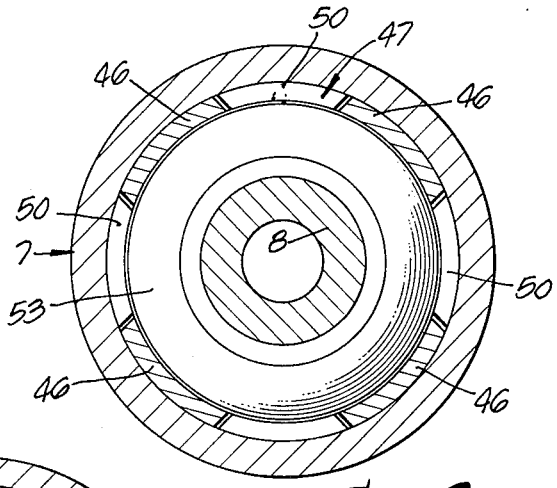
FIG. 3 is a section on line 3—3 of FIG. 2A.
Figure 4:
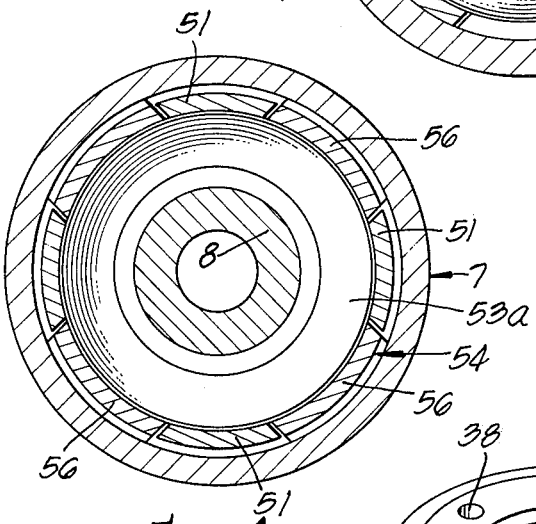
FIG. 4 is a section on line 4—4 of FIG. 2B.

The drill string 1 composed of a kelly, drill pipe, drill collar, suspended from a drilling rig (not shown) is connected through a conventional dump valve 2 to a stator 3 of a progressive cavity motor. The rotor 4 is connected through universal joints to the connecting rod 5. The connecting rod is connected through the universal joint by a screw connection to the drive shaft cap 11 (see FIG. 2B). The drive shaft cap 11 is screw connected to the hollow drive shaft 8 which, in turn, is connected to the bit (see FIGS. 1 and 2B).

The stator 3 is connected by a box and pin connection to connecting rod housing 6 which, in turn, is connected via a box and pin connection to the bearing housing 7.

The drive shaft cap 11 carries ports 10 connecting the interior of the cap 11 and hollow drive shaft with the interior of the connecting rod housing 6. The ring holder sleeve 12 is locked to the cap 11 by the keys 13 and the retaining ring 14.

The flow restrictor inner sleeve 15 is connected to the ring 16 by a corrugated flexible circular boot 17 mounted on the sleeve 15. The ring 16 carries dogs 18 fitting in slots 19 in the ring 12 so that it may be flexibly connected to the shaft 8 for transverse displacement but rotatable with the shaft. The flow restrictor outer sleeve 20 is mounted on the interior of the bearing housing 7 at the pin end and is spaced radially from the sleeve 15. The floating sleeve 15 is spaced from the shaft by an annulus 21*a*.

The sleeve 15 is circumferentially grooved and carries an outer sleeve 15*a* formed of hard material, such as tungsten carbide, boron nitrite, silicon carbide, alumina and other hard material, for example, of in excess of Knoop or Vickers hardness of about 2000. The outer sleeve 20 may be constructed of like material. Materials, such as tungsten carbide and alumina, may be formed into a solid cylinder or be formed by dispersion of particles of such materials, including diamond particles in a metallic matrix.

The flow restrictor elements of my invention may be fabricated by standard techniques from tungsten carbide or ceramic material, such as alumina. A preferable material is the metal-bonded hard particles, such as have been employed in the abrader arts.

The methods for producing shapes of metal-bonded hard materials, such as referred to above, are described in the Wilder et al U.S. Pat. Nos. 3,757,878; 3,757,879; and 3,841,852.

The particles of hard material, such as described above, may be dispersed in a metal matrix powder and introduced into a mold of desired shape. The temperature of the mold is raised to fuse the metal and bond the particles. The particles of hard material, for example, of Knoop hardness in excess of 2000 are dispersed and held in the metal matrix, such as copper-based alloys, such as brass or bronze alloys, and copper-based alloys containing other alloying metal, such as one or more of the following: nickel, cobalt, tin, zinc, manganese, iron, and silver. The matrix-bonded material has suitable compressive and impact strength and micro-hardness (see Wilder U.S. Pat. No. 3,841,852, col. 7, line 53, et seq.).

The drilling mud exiting from the stator passes through the ports 10 into and through the drive shaft and bit nozzles to be returned to the surface via the annulus between the drill string and the bore hole. A portion of the flow is bypassed around the sleeve 12 and boot 17 and through the annulus 21 between 15 and 20. The housing 7 is bored at 22 to connect the discharge end of the annulus 21 with the ambient space exterior of the housing via port 22.

The top seal sleeve 23 shoulders at 23*a* and is kept from rotating by set screw 25. Mounted between sleeve 15 and the sleeve 23 is a packing 26 in sealing contact with the sleeves 23 and 15. The packing is held against upward displacement by the internal nut 27. The lower end of the packing 26 is seated on the ring shoulder 26*a*. Radial bearing 28 is positioned against the internal shoulder 29 of the sleeve 23. The sleeve 15 is held against transverse displacement at its lower end by the retaining ring 30 positioned on the drive shaft 8. Spacer sleeve 30*a* is seated between radial bearing 28 and radial bearing 31, which is positioned against shoulder 31*a* of the sleeve 23.

Figure 5:
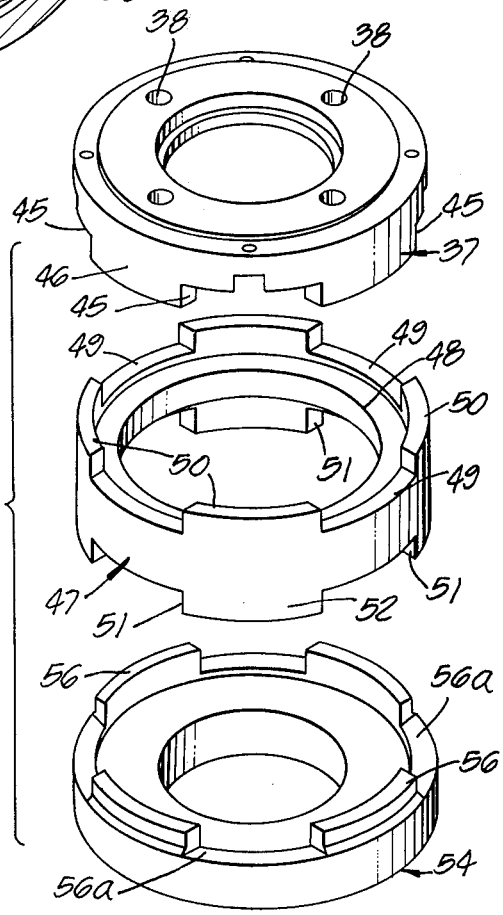
FIG. 5 is an exploded view of a detail of FIGS. 2A and 2B.

The plate 32 is pinned by pins 33 to the lower end of the sleeve 23 and is seated on and secured by studs 35 to the upper end of the lubricator housing sleeve 36. The plate 32 carries bores 34. The lower end of the sleeve 36 is connected to a cup 37 (see FIGS. 2A and 5) carrying bores 38. Mounted between the plate 32 and cup 37 is the interior lubricator housing sleeve 39 forming with the plate 32 and cup 37 and sleeve 36 an enclosed space 40.

The expandable bellows 41 is mounted on the interior bossage 42. The interior of the bellows is connected to the exterior of the housing 7 by port 43, circular groove 44, and port 45. For further details of the construction and function of the seal and lubricator, reference is made to the copending application Ser. No. 388,586.

Positioned beneath the cup 37 and in bearing contact therewith are the stacked Belleville spring washers 53 seated on bossage 48. Cup 37 is notched with a plurality of circumambient notches 45 in the dependent sleeve portion 46 of the cup 37. The floating sleeve 47 carries an internal bossage 48 and is notched at its upper end with a plurality of circumambiently positioned notches 49 between which are positioned upstanding sleeve portions 50. The lower end of the sleeve 47 is similarly notched at 51 with the depending sleeve portion 52 positioned between the notches 51.

The stacked Belleville spring washers 53*a* are positioned and in bearing contact with the under side of the bossage 48 and the bearing ring 54.

The bearing ring 54 (see FIG. 5) carries upstanding circular dogs 56 between which are positioned notches 56*a*.

The ring 54 sits on the thrust bearing 55 which sits on the thrust ring assembly 57 and on the bossage 59*b* on the drive shaft 8. The thrust ring 58 sits in the notch 59 on the drive shaft in bearing relation to the thrust bearing 60. The off-bottom bearing sleeve 61 carries a bossage 62 providing an upper shoulder 63 and a lower shoulder 64. The thrust bearing 60 is settled in thrust transfer relation on the shoulder 63 and the stacked Belleville spring washers 65 are positioned in thrust relation to the shoulder 64 and the spacer 66 keyed to 61 by key 67. The radial bearing 70 is positioned on the internal shoulder 69 of the sleeve 68 and underneath the spacer 66.

The lower sleeve assembly includes a radial bearing 72 mounted on the internal shoulder 71 of the sleeve 68, which carries the seal 74. The wear sleeve 75 is mounted on the bit sub 79 by means of the ring 77, flexible corrugated sleeve 76, and ring 78. The sleeve 75 is spaced radially from the shaft 8 and is in sealing contact with the seal 74.

When the motor and the connecting rod and shaft have been assembled and before connecting it to the drill string, the nut 80 is screwed against the shoulder 81. This introduces a thrust against 81 which is transmitted through 68 and bearing 70, spacer 66, springs 65, bossage 62 to the bearing 60 and against ring 58 in notch 59. This is a terminal point of the upward thrust imposed by the nut 80.

However, simultaneously as the nut enters the housing, the housing moves downward; that is, a thrust is imposed at the shoulder 23*a* (FIG. 2A) which is transmitted through 23 to 32 and via 36 to 37 and thus to the Belleville springs 53 and via the floating ring 47 and to Belleville springs 53*a* and via ring 54 and bearing 55 to the ring 58 which is thus the terminal end of the downward thrust.

The load imposed on the system of springs 53, 53*a*, and 65 is thus uniform.

Figure 2A:
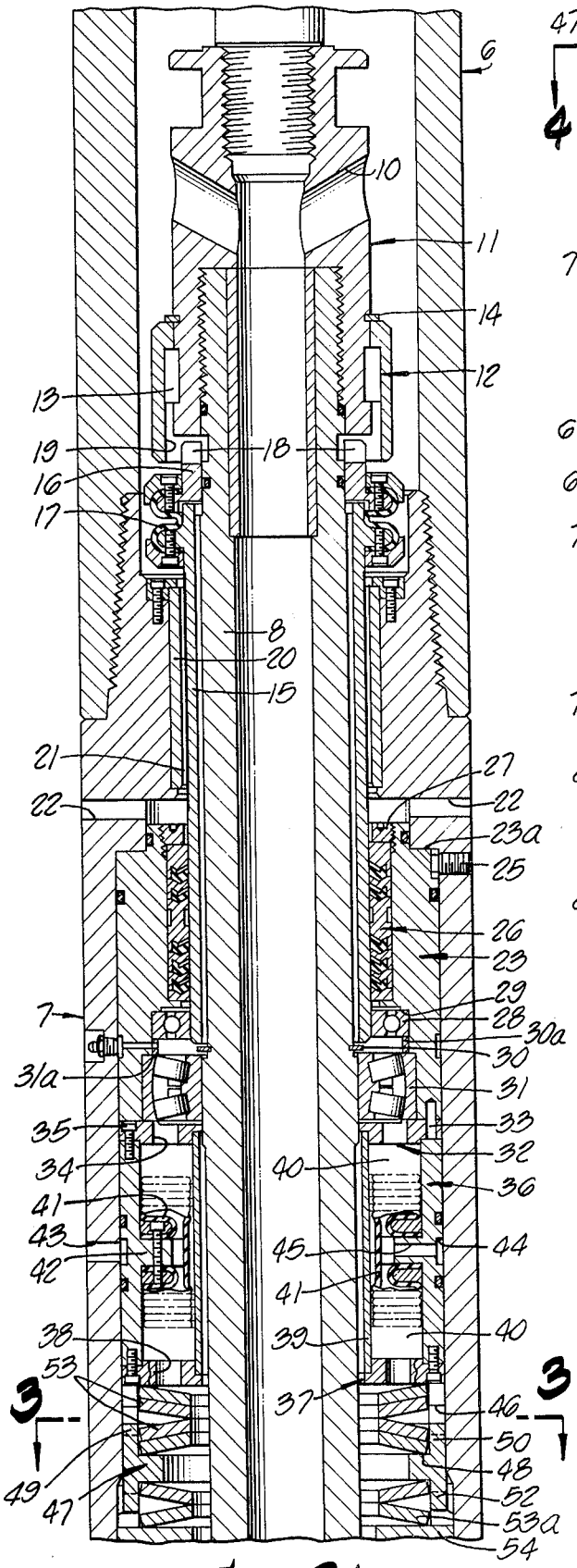
FIGS. 2A and 2B are a section on line 2—2 of FIG. 1.
Figure 2B:
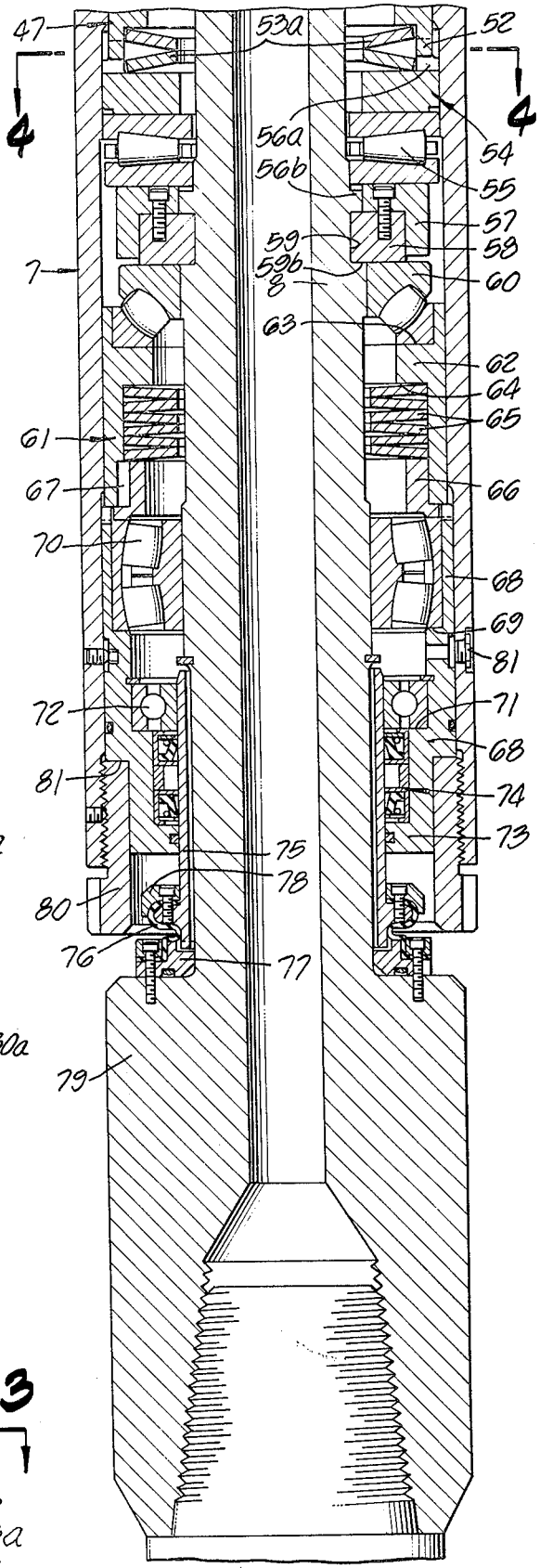
Figure 6:
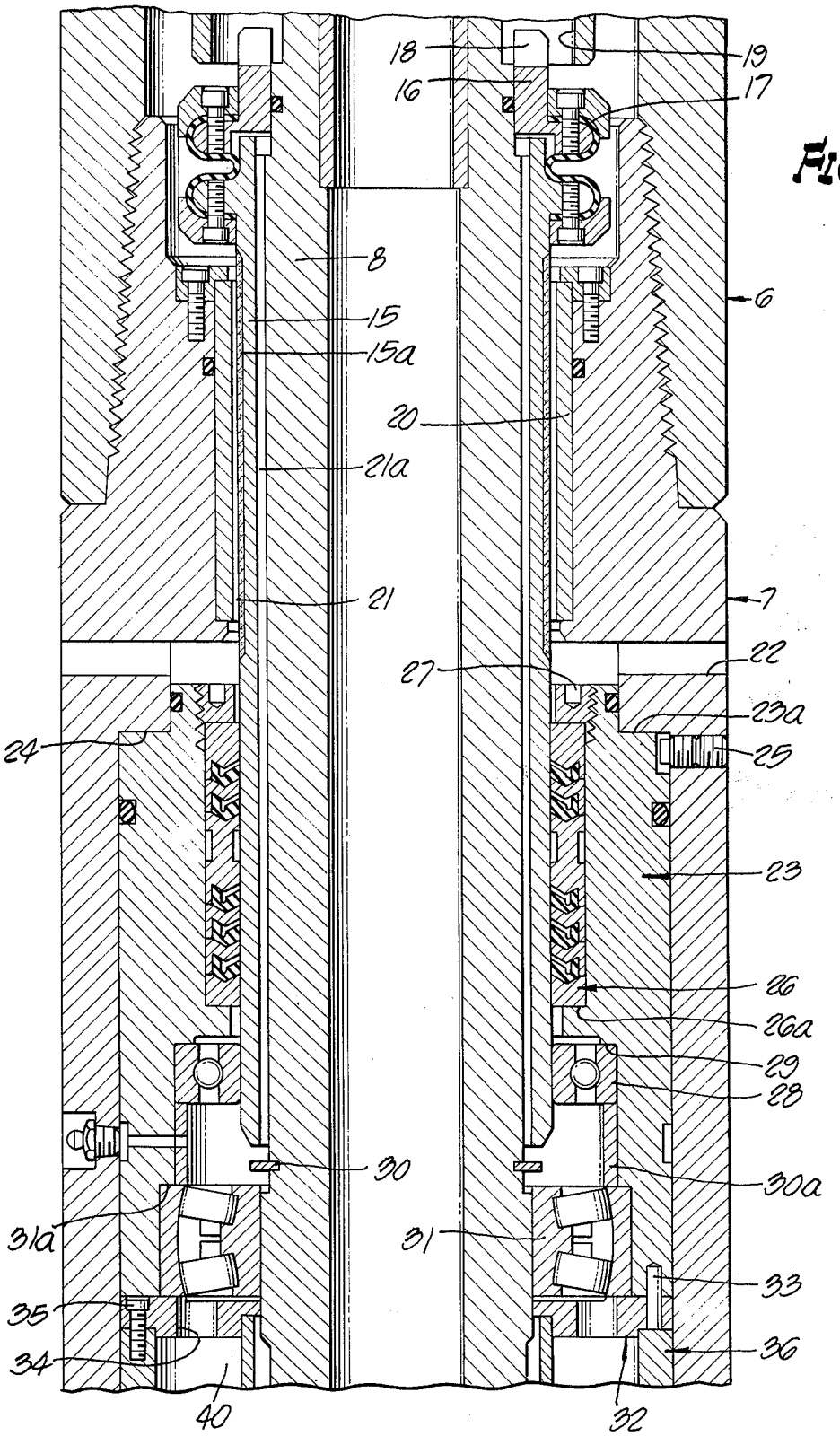
FIG. 6 is an enlarged section of a portion of FIG. 2A.

In the position shown on FIGS. 2A and 2B, the entire weight of the drill string, including the drill pipe, drill collar, stator 3, and housings 6 and 7 is on the drilling lines. The drill bit is off bottom. The load of the housing is off bearing 55. Circulation of drilling fluid continues.

The rotor, connecting rod, shaft, and bit hang on the thrust bearing 60 via the thrust ring assembly 57 and 58. The precompression load imposed on the springs 53 and 53*a* also imposes an initial load on bearing 55 which thus prevents separation of the races when the load on the string is not on the bearing 55. The only load on the thrust bearing 55 is a portion of that which imposed the compression previously referred to.

When the drill string is lowered and as the bit touches bottom, the pump pressure rises as the thrust load is developed. When the pump discharge pressure at the inlet to the drill string rises to the level to develop the desired torque, the driller adjusts the lines to give him the level of pressure at which he will obtain the desired torque.

As he lowers the drill to bottom, the housing 3, 6, and 7 and spacer 66, sleeve 68, and seal 74 move downward relative to the shaft as they do relative to 61. The load comes off the bearing 60; the springs 65 are relieved of but a fraction of the precompression load. The residual load of springs 65 is thus applied to 60 to prevent the separation of the races and loss of the rollers in 60. It also prevents chatter in the bearing 60.

The load from the housing is applied via shoulder 23*a* to sleeve 23, plate 32, sleeve 36, and cup 37. The springs 53 are loaded; and the load is transmitted via 48 to the springs 53*a*. The spring rate of 53*a* is less than that of 53. The cup 37 moves downward as does the ring 47. The depending sections 52 enter notches 56*a* until they seat in the notches 56*a*. This is the terminal end of the compression because of the position of the bearing 55 on the ring 57. The load thus transferred is imposed on the bearing 55 and the shaft 8 (see FIG. 2B).

However, the cup 37 has not moved down sufficiently so that the upstanding portion 50 of sleeve 47 has not entered completely into notch 45 of the sleeve 46. Further loading is thus permissible, and the springs 53 deflect further until portions 46 of cup 37 have bottomed in the notches 49 of ring 47.

As will appear from the foregoing, any axial or radial displacement of the shaft, such as will be encountered in ordinary operations, will cause only a minimal axial displacement of the sleeve 15 with respect to the packing 26, and thus the integrity of the seal is maintained. The annulus 21*a* is substantially greater than the annulus 21 and thus in the ordinary operation of the system, the transverse displacement of the shaft will not be sufficient to impose a substantial radial thrust on the floating sleeve 15. Impact forces sufficient to cause damage to the hard materials in the sleeve 15 and the complementary sleeve are thereby prevented.

The annulus 21 is made of such small radial dimensions and of such length that the impedance to flow along the annulus to the vent will be such that at the pressure differences established along the annulus the flow volume is within the tolerable limits described above.

We claim:

1. A hydraulic motor including a stator in a housing and a rotor in said stator, a shaft connected to said rotor, a fluid inlet to said stator, and a fluid outlet from said stator, a thrust bearing mounted on said shaft and housing, a fluid passageway connected to the fluid outlet from said stator through the housing, a flow restrictor positioned in said passageway between the stator outlet and said thrust bearing, said flow restrictor comprising a first sleeve flexibly mounted at one end of said sleeve on said shaft and spaced radially from said shaft and forming an annular space between said shaft and said first sleeve, a radial bearing mounted at the other end of said first sleeve and between said first sleeve and said housing, a second sleeve mounted on said housing adjacent to but spaced radially from said first sleeve.

2. The motor of claim 1, a packing gland mounted on said housing between the ends of said first sleeve, said first sleeve forming a seal fit with said gland.

3. The motor of claim 1 in which said flexible connection comprising a boot mounted at said one end of said first sleeve and said shaft and closing said annular space.

4. The motor of claim 3, a packing gland mounted on said housing between the ends of said first sleeve, said first sleeve forming a seal fit with said gland.

5. The motor of claim 1, in which the facing surfaces of said sleeves are formed of hard material having a Knoop hardness in excess of about 2,000.

6. The motor of claim 5, a packing gland mounted on said housing between the ends of said first sleeve, said first sleeve forming a seal fit with said gland.

7. The motor of claim 5 in which said flexible connection comprising a boot mounted at said one end of said first sleeve and said shaft and closing said annular space.

* * * * *